US009249579B2

(12) United States Patent
Dickey et al.

(10) Patent No.: US 9,249,579 B2
(45) Date of Patent: Feb. 2, 2016

(54) KIT FOR STONE VENEER PANEL INSTALLATION

(71) Applicant: Ply Gem Industries, Inc., Cary, NC (US)

(72) Inventors: Eric. B. Dickey, Overland Park, KS (US); John M. Wade, Pleasant Hill, MO (US); Derek Zimmerman, Mifflinburg, PA (US); Alan F. Hoying, Sidney, OH (US); Bryan K. Beasley, Kearney, MO (US); Kaleb Hahn, Kansas City, MO (US); Ted Gavalas, Kansas City, MO (US); David Barrett, Jr., Selinsgrove, PA (US)

(73) Assignee: Ply Gem Industries, Inc., Cary, NC (US)

( * ) Notice: Subject to any disclaimer, the term of this patent is extended or adjusted under 35 U.S.C. 154(b) by 0 days.

(21) Appl. No.: 14/702,681

(22) Filed: May 2, 2015

(65) Prior Publication Data

US 2015/0233122 A1 Aug. 20, 2015

Related U.S. Application Data

(63) Continuation-in-part of application No. 14/133,205, filed on Dec. 18, 2013, now Pat. No. 9,021,767.

(51) Int. Cl.

| | |
|---|---|
| ***E04B 1/00*** | (2006.01) |
| ***E04F 13/08*** | (2006.01) |
| ***E04F 13/00*** | (2006.01) |
| ***E04F 13/076*** | (2006.01) |

(52) U.S. Cl.

CPC ..... *E04F 13/0846* (2013.01); *E04F 13/007* (2013.01); *E04F 13/076* (2013.01); *E04F 13/0873* (2013.01); *E04F 13/0894* (2013.01)

(58) Field of Classification Search

CPC ..... E04B 2/7457; E04B 9/26; E04B 9/363; E04B 9/064; E04B 9/065; E04F 15/02; E04F 15/04; E04F 2201/0115; E04F 2201/153; E04F 2201/023

USPC ..... 248/174, 300, 903; 52/483.1, 489.1, 52/506.04, 506.05, 506.08, 746.12, 747.1, 52/747.12

See application file for complete search history.

(56) References Cited

U.S. PATENT DOCUMENTS

| | | | | |
|---|---|---|---|---|
| 4,163,350 | A | 8/1979 | Doguchi et al. | |
| 8,322,103 | B1 * | 12/2012 | Kownacki | E04F 13/0733 52/235 |
| 8,407,895 | B2 | 4/2013 | Hartelius et al. | |
| 8,424,255 | B2 | 4/2013 | Lenox et al. | |
| 8,667,744 | B2 | 3/2014 | Shaw | |
| 8,782,988 | B2 * | 7/2014 | Wolf | E04F 13/147 52/526 |
| 9,021,767 | B1 * | 5/2015 | Barrett, Jr. | E04F 13/0826 248/300 |
| 9,027,302 | B2 * | 5/2015 | Buoni | E04F 13/0733 52/311.1 |
| 2004/0010998 | A1 | 1/2004 | Turco | |
| 2009/0056257 | A1 * | 3/2009 | Mollinger | B29C 7/0032 52/314 |
| 2009/0241451 | A1 | 10/2009 | Griffiths | |
| 2013/0125492 | A1 | 5/2013 | Molek et al. | |
| 2015/0233122 | A1 * | 8/2015 | Dickey | E04F 13/0846 52/302.1 |

* cited by examiner

*Primary Examiner* — Gwendolyn Baxter
(74) *Attorney, Agent, or Firm* — Lathrop & Gage LLP

(57) ABSTRACT

A kit for securing stone veneer panels to a structure, the kit comprising a plurality of stone veneer panels with upper and lower flanges, a plurality of brackets for securing the panels to the structure and a filler panel for placement between adjacent vertically disposed stone veneer panels to fill the gap between the panels. The brackets are secured to the structure through a bracket center mount and also utilize upper and lower wing walls to form a channel for receipt of the flange of the panels.

23 Claims, 10 Drawing Sheets

KIT FOR STONE VENEER PANEL INSTALLATION

RELATED APPLICATIONS

This application is a continuation-in-part of U.S. application Ser. No. 14/133,205 filed on Dec. 18, 2013, the disclosure of which is incorporated herein by reference.

FIELD OF THE DISCLOSURE

This disclosure relates in general to the construction of stone veneer panels on building structures. More specifically, the invention relates to the utilization of a kit for constructing a stone veneer panel comprising brackets, veneer panels and filler panels to fill the gap between installed panels. The panel kit effectively expedites the construction of the veneer panels, reduces costs and produces a high quality, realistic-looking, structurally sound wall.

BACKGROUND

Stone walls are expensive to construct from both a material and labor perspective. Stone veneer panels expedite the construction process by allowing the installer to utilize stone veneer panels with a large surface area to quickly cover large, structural areas once a framework using specially designed brackets are installed.

Present methods of stone wall construction typically utilize skilled masons whose services are expensive and can therefore add substantially increased cost to the final product. Moreover, the presently described apparatus and kit will require less time than the utilization of skilled masons to produce a high quality wall and generally will require less time than the present method but will not result in any lesser of a visually pleasing final product.

Accordingly, there exists a need for a stone veneer panel installation kit that may be quickly installed with minimal masonry skills on the part of the installer and yet produce a veneer wall that is seamless and realistic-looking in comparison to an authentic stone wall.

In view of the foregoing disadvantages inherent in the prior art, the general purpose of the present stone veneer installation kit is to provide the user with the equipment and the methodology for quickly and efficiently installing a realistic stone veneer panel using brackets that are specially configured to interface with the veneer panels.

An object of the disclosed technology is to provide a kit that includes a plurality of brackets, veneer panels and filler panels. The brackets are fastened to a building structure with fasteners through a center mount in the bracket. The brackets comprise two channels, formed by wing walls extending outwardly from the upper and lower sides for receiving longitudinally running flanges disposed on the upper and lower edges of the veneer panels. A stone veneer wall is typically constructed from the bottom-up, meaning that the lower-most veneer panel is installed on the structure first. Following the installation of the lower veneer panel a filler panel is installed above the lower panel and securely locked into position with the aid of interlocking flanges on the veneer panel and the filler panel. Optionally, an adhesive may be applied to secure the filler panel to the bracket. Once the filler panel is in position, the installer places the upper veneer panel into position above the filler panel further utilizing the interlocking flanges of both the veneer panel and the filler panel. Once the upper veneer panel is in position the filler panel cannot be outwardly extracted from the wall as the beveled edges of the filler panel and the veneer panels interfere with one another preventing outward translation of the filler panel.

Another object of the invention is to provide a stone veneer panel kit that extends the paneling away from the structure to allow movement of air and facilitate drainage of water. The brackets are specifically configured to position the panels away from the structure, providing a pathway for air to circulate and allowing passage of water down the surface of the wall unimpeded by the rear surface of the stone veneer panels. With increasing litigation over exposure to toxic mold in residential settings significant effort has been brought to bear on the elimination of construction methodologies that capture and pool moisture that ultimately leads to mold growth. Spacing between structural and ornamental layers in residential and commercial settings, sufficient for movement of air that aids in evaporation of water, will substantially reduce the prospect of mold formation.

Another object of the disclosed technology is to provide a bracket that is lightweight yet sufficiently rigid to support a stone veneer wall using opposed channels to support the flanges of stone veneer panels.

These, together with other aspects of the disclosed technology, along with the various features of novelty that characterize the technology, are pointed out with particularity in the claims annexed hereto and form a part of this disclosed technology. For a better understanding of the disclosed technology, its operating advantages and the specific objects attained by its uses, reference should be made to the accompanying drawings and descriptive matter in which there are illustrated exemplary embodiments of the disclosed technology.

BRIEF DESCRIPTION OF THE DRAWINGS

Illustrative embodiments of the disclosed technology are described in detail below with reference to the attached drawing figures, which are incorporated by reference herein and wherein.

DETAILED DESCRIPTION

Embodiments of the disclosed technology can be included within a kit for constructing a stone veneer panel wall. To provide context for the disclosed technology, consider FIGS. 1-10, which show the preferred embodiment of the panels and bracket.

Figure 1:
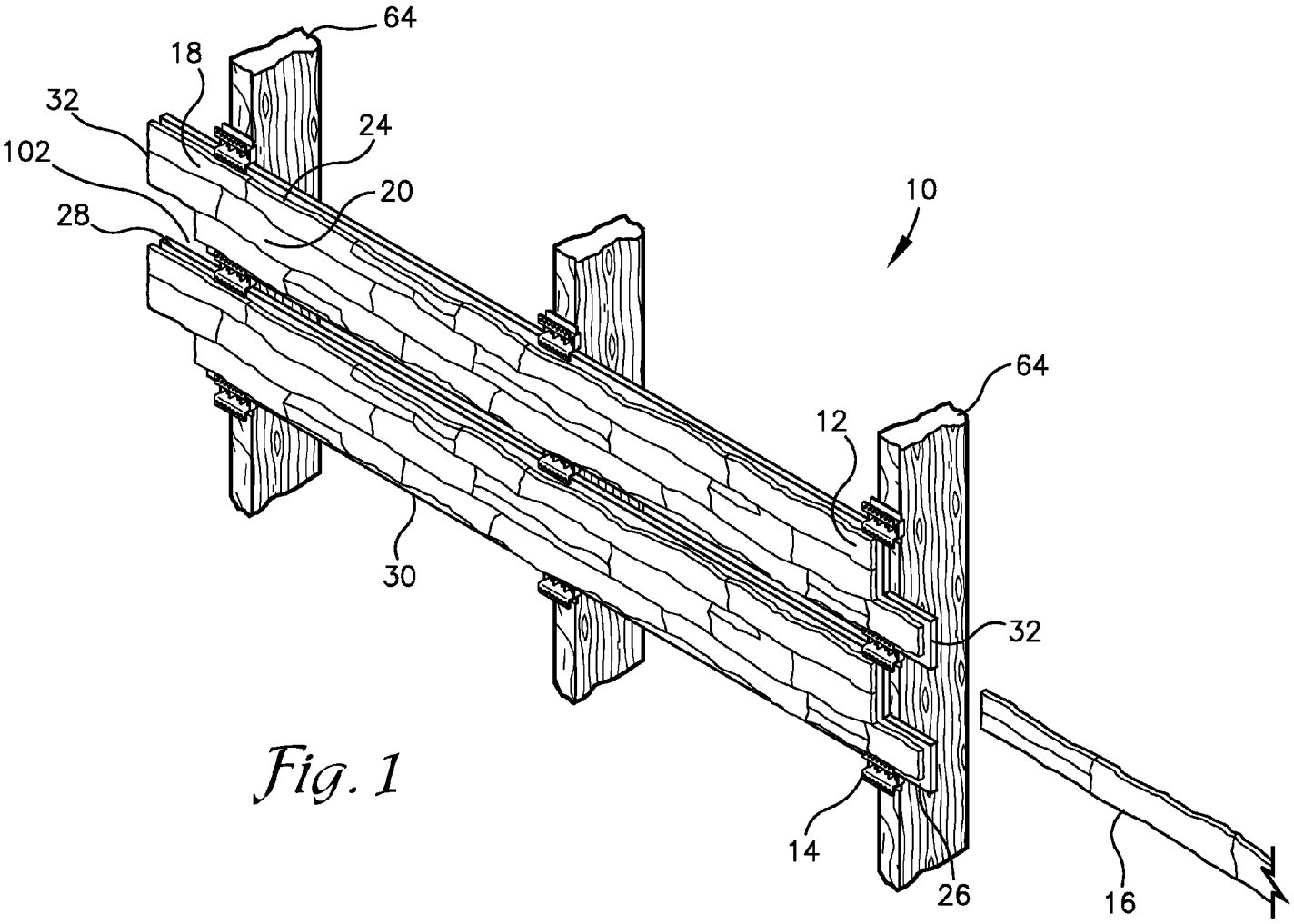
FIG. 1 is a perspective view of a portion of an embodiment of a stone veneer wall with stone panels, brackets and a filler panel that is positioned between the stone panels.
Figure 10:
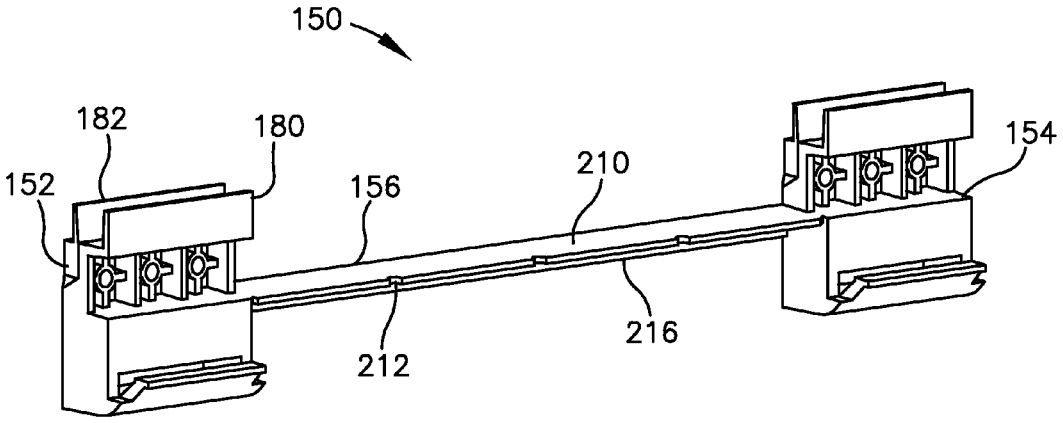
FIG. 10 is an isometric view of an embodiment of a starter bracket for a first course of a stone veneer panel.

The stone veneer panel kit 10 is shown partially assembled at FIG. 1 and fully assembled at FIG. 10 is configured for attachment to a rigid vertical structure such as an exterior or interior wall of a building. The panel kit 10 is comprised of stone panels 12, brackets 14 and filler panels 16 which are all used in combination to produce a stone wall that is seamlessly integrated with an appearance that is remarkably similar to a wall finished by a professional stone mason using stone blocks.

The concrete stone panels 12 and filler panels 16 are fabricated from a composite mixture of Type 1 Portland cement and lightweight aggregate. The lightweight aggregate includes rotary kiln expanded slate lightweight aggregate, such as that produced by the Stalite Company. The lightweight concrete produced from the mixture of the Type 1 Portland cement and the lightweight aggregate preferably weighs less than 95 pounds per cubic foot.

Figure 2:
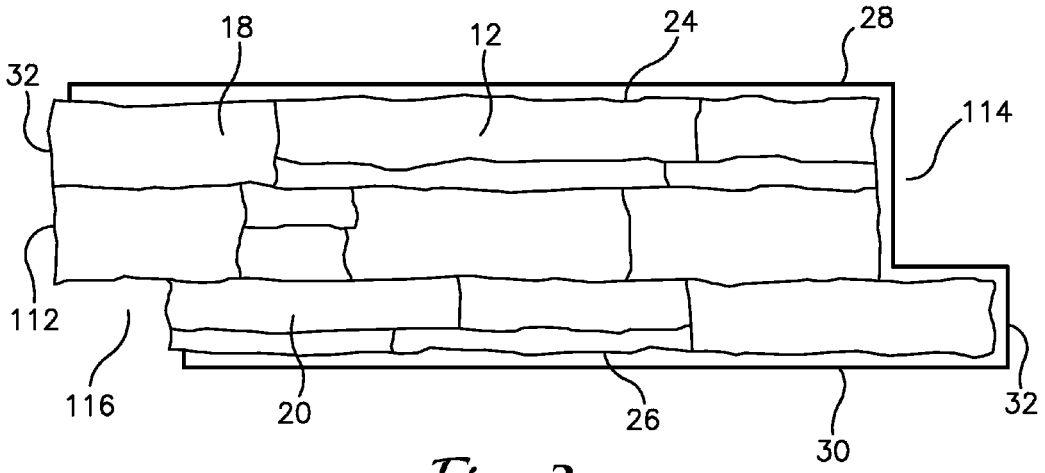
FIG. 2 is a front elevation view of an embodiment of a stone panel.

As seen in FIG. 2, the stone panels 12 include a textured front surface 18 that simulates the look and feel of natural stone. The textured front surface 18 includes stones 20 in a variety of heights and widths and can be produced in a single color or with stones in multiple colors. The panel 12 is produced from concrete and formed in a rubberized mold which facilitates extraction of the stone panel 12 upon curing of the concrete.

Figure 7:
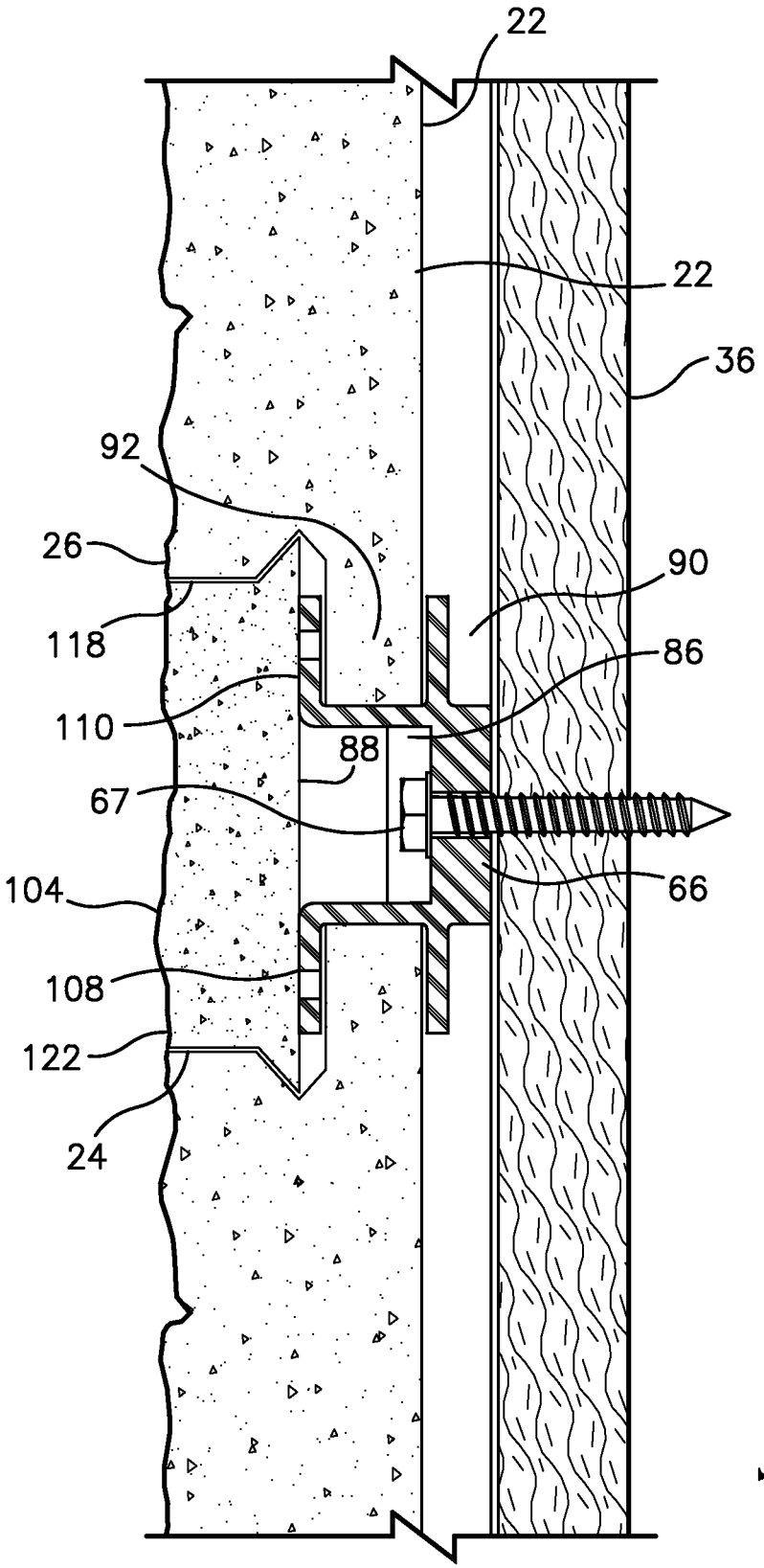
FIG. 7 is a sectional view of an embodiment of a bracket secured to the building structure with a fastener and showing embodiments of two stone panels in position between the upper and lower wing walls and an embodiment of a filler panel disposed between the upper and lower stone panels.

As is best seen in FIG. 7, the stone panel 12 further includes a rear surface 22 that is substantially flat. The thickness of the stone panel 12 is generally less than 3 inches and preferably in the range of 1.5 to 2 inches overall. Different heights and widths of the stone panel may be made available depending upon the texture and coloration of the front surface 18 of the panels. Referring again to FIG. 2, the panel 12 also includes an upper surface, or ledge, 24 and a lower surface, or ledge 26, that are textured consistent with the stone paneling but are substantially level. As seen in FIGS. 1 and 2, extending outwardly from the stone panel at the upper and lower ledges 24, 26 are flanges 28, 30 that are for receipt into the bracket 14, which are be more fully described below. The upper and lower panel flanges 28, 30 traverse nearly the entire circumference of the panel and may extend to the outer reaches of the overhang portion 32 or may terminate short of the overhang portion 32. The flanges 28, 30 are preferably from 0.25 to 0.75 inches in thickness and preferably in the range of from 0.25 inches to 0.75 inches in height but may be fabricated in a variety of widths and heights to accommodate different widths of bracket channels 34. The flanges 28, 30 must; however, be of sufficient thickness to avoid readily fracturing from impacts with the brackets during installation and inadvertent impacts with other solid objects. Likewise, the flanges 28, 30 cannot be too thick or the weight of the panels 12 becomes an impediment to efficient manual installation.

As previously noted, the overhang portions 32 exist on both the upper 24 and lower 26 ledges of the panel 12 but on opposite sides of the panel and serve to diminish creating an unappealing block appearance to the finished wall. Some panels in the kit do not include one of the overhangs so that the wall veneer can be properly finished. For example, in one embodiment an overhang 32 extends outwardly to the left at the top of the panel 12 but not to the right at the bottom of the panel. This panel 12 is for completing a section at the right side of the wall. In another panel embodiment there is an overhang 32 that extends outwardly from the panel 12 to the right but not at the bottom left of the panel 12. This panel would be utilized to complete a section at the left side of the wall. Various permutations of panels with overhangs on one or both sides are required to fully complete most wall sections.

In order to secure the stone veneer panels 12 to a structure 36, the kit 10 includes brackets 14 that are constructed of a sturdy material, such as steel, aluminum or engineered plastic and that are capable of supporting a stone veneer panel 12 without fracturing or bending. The brackets 14, as seen in FIGS. 3-6, are preferably configured as a box 38 with two lateral walls 40, 42 and two longitudinal walls 44, 46. Each lateral wall has an interior surface 48, 50 as well as an upper edge 56 and a lower edge 58.

Figure 3:
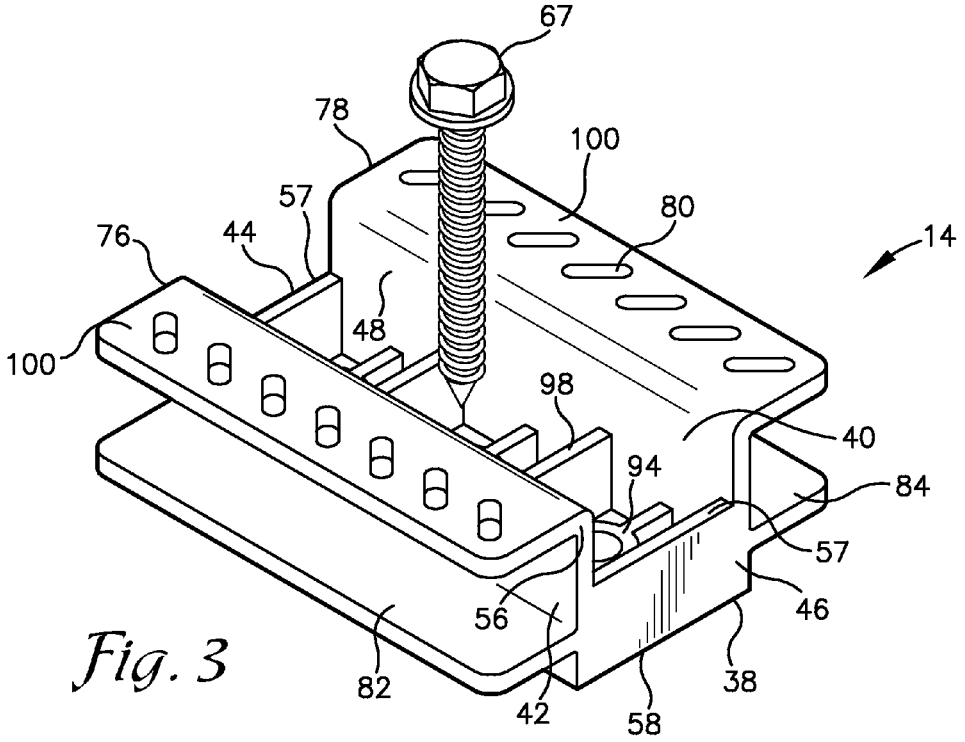
FIG. 3 is a perspective view of an embodiment of a panel bracket with a securing screw in position adjacent the bracket.
Figure 4:
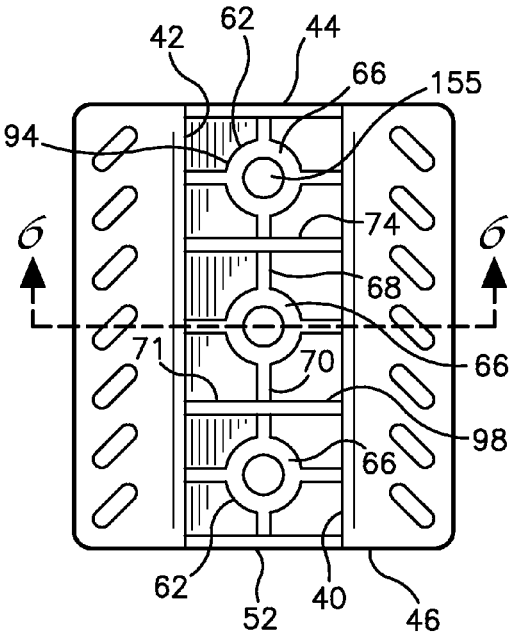
FIG. 4 is a top plan view of an embodiment of a bracket displaying the top wing walls.
Figure 5:
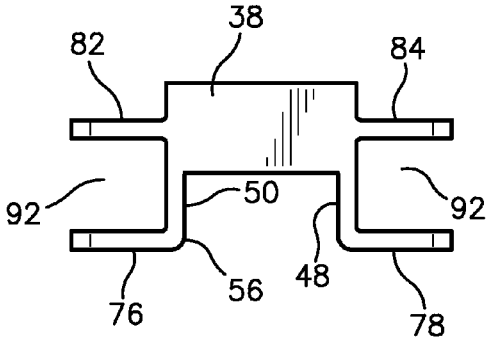
FIG. 5 is a side elevation view of an embodiment of a bracket detailing the two sets of wing walls.
Figure 6:
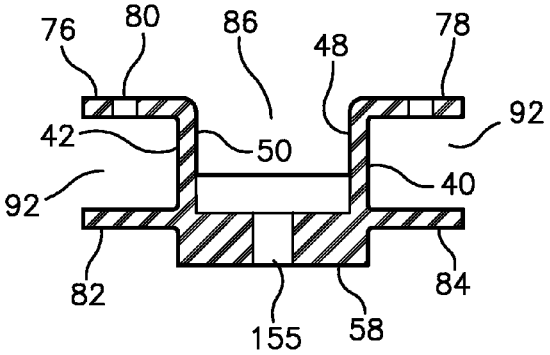
FIG. 6 is a cross sectional view of an embodiment of a bracket shown in the direction 6-6 of FIG. 4.

As best seen in FIGS. 3 and 4, the bracket box 38 employs a center mount 62 for securing the bracket to a structural feature such as a wall stud 64. The center mount 62 preferably comprises one or more adjacent circular lugs 66 through which an attachment means 67, preferably threaded, is passed to secure the bracket to a wall stud 64. As seen in FIGS. 4 and 6, the circular lugs 66 are configured with a round opening 155 to accommodate, for example, a hexagonal headed cap screw 67 that is of sufficiently robust dimensions to support the weight of a bracket 14 that is loaded with a veneer panel 12. As seen in FIG. 4, the circular lug 66 is secured to two lateral webs 68, 70 that in turn are secured to two longitudinal webs 72, 74. The longitudinal webs 72, 74 are themselves secured to the two lateral walls 40, 42. The webs 68, 70, 72, 74 are sufficiently robust in their dimensions and in their connection strength to adjoining webs and walls to support the weight of the stone veneer panels 12.

As seen in FIGS. 3-6, the bracket 14 further employs upper wing walls 76, 78 that extend outwardly from above the upper reaches 56 of the lateral walls 40, 42. As seen in FIG. 3, the upper edges 57 of the longitudinal walls 44, 46, the upper surface 94 of the circular lug 66 and the upper edges 98 of the longitudinal webs 72, 74 are recessed below the top surface 100 of the upper wing walls 76, 78. All of these surfaces are recessed below the upper wing wall surface 100 creating an inner slot 86 in the bracket 14 which is best seen in FIG. 6.

As best seen in FIG. 7, the upper wing walls 76, 78 extend outwardly approximately 0.75 inches and preferably traverse the entire length of the lateral wall 40, 42 of the bracket box 38. However, upper wing walls 76, 78 of a lesser traverse may also satisfy the desired objective. The upper wing walls 76, 78 also preferably include through holes 80 that facilitate the adhesion of an industrial adhesive applied to the upper and lower back surfaces 108, 110 of the filler panel 16 and the upper surface of the wing walls 76, 78 for purposes of further enhancing the secure placement of the panel 16 to the wing walls 76, 78.

As seen in FIGS. 3-6, situated beneath the upper wing walls 76, 78 are lower wing walls 82, 84. The lower wing walls 82, 84 run parallel to the upper wing walls 76, 78 and extend substantially perpendicularly outwardly from the bracket box lateral walls 40, 42. The lower wing walls 82, 84 are situated beneath the upper wing walls 76, 78 and separated from the upper wing walls by approximately 0.75 inches; however, separation distances can vary depending upon the size of the panel flanges 28, 30 that are to be utilized in the wall construction. As seen in FIG. 6, the lower wing walls 82, 84 do not extend outwardly from the lowest edge 58 of the bracket box 38 but extend outwardly above the lower edge 58 so that when the flanges 28, 30 of the stone panels are received into the channel 92 the rear surface 22 of the panel 12 does not contact the wall stud 64 or the wall surface. The bracket 14 design purposefully avoids contact between the rear surface 22 of the panel 12 and the wall studs 64, or wall surfaces, in order to create an air gap 90, as best seen in FIG. 7. Because the lower wing walls 82, 84 are positioned away from the lower edge 58 of the bracket 14 air can circulate behind the stone veneer panel 12 when it is installed. The gap 90 allows air to circulate which facilitates moisture removal thereby limiting the growth of mold.

As seen in FIG. 6, the separation distance between the upper wing walls 76, 78 and the lower wing walls 82, 84 forms a channel 92 for receiving either the upper panel flange 28 or the lower panel flange 30. The brackets 14 are installed so that the channels 92 are horizontal in orientation and can receive both upper and lower flanges 28, 30 in order to stabilize the panel 12 when in position against a structure 36.

The highest and lowest course of panels on a wall may use an alternative embodiment of the bracket 14 described above. The alternative embodiment of the bracket 14 includes an upper and lower wing wall 76, 82 on a single side of the bracket box 38. The lowest course of panels on a wall only requires a bracket 14 with a single upward facing channel 92 for receiving a panel that it is supporting from below. The uppermost course of panels only needs a bracket 14 with a single downward facing channel 92. This alternative embodiment of the brackets 14 facilitates finishing of the wall above and below the edges of the panels.

Figure 8:
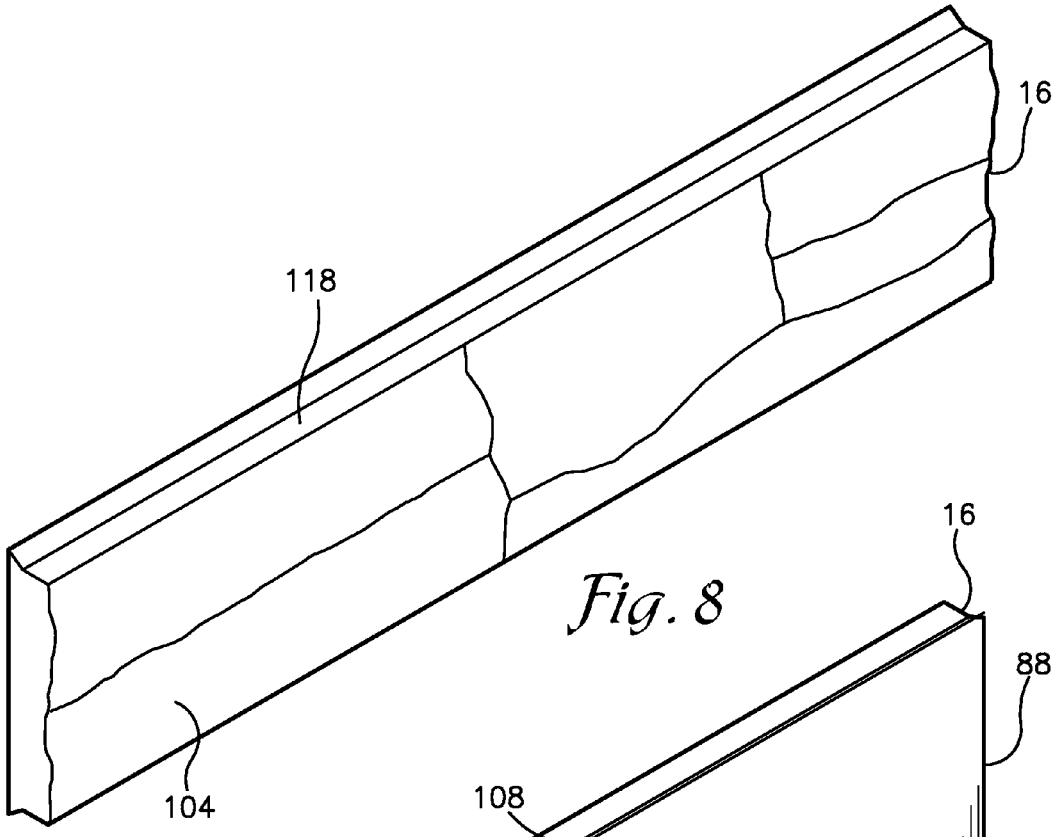
FIG. 8 is a perspective view of the front textured surface of an embodiment of a filler panel.
Figure 9:
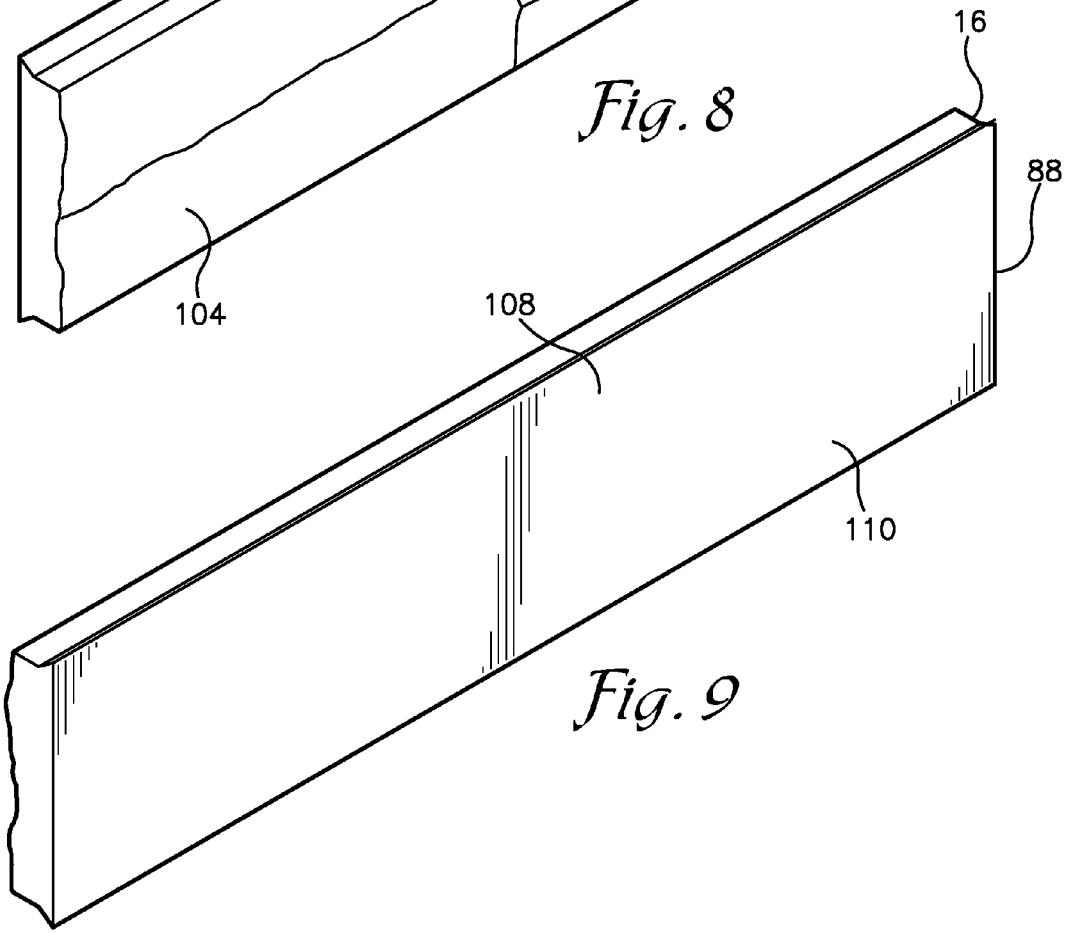
FIG. 9 is a perspective view of the rear surface of an embodiment of a filler panel with an outwardly extending center rib.

As seen in FIG. 8, the veneer panel kit 10 also includes a filler panel 16 for placement into the gap 102 between vertically adjacent panels 12. The filler panel 16 has a front surface 104 that is textured consistent with the front surface of the stone panels 12. The back surface includes upper and lower regions 108, 110 seen in FIG. 9, is generally smooth. As previously noted, to assist in securing the filler panel 16 in position between vertically adjacent panels, a flexible construction adhesive is optional for all stone panel installations up to a height of ten feet above grade. Any stone panel installation more than ten feet above grade must have a flexible adhesive applied to the flat portion upper and lower regions 108, 110 such that when placed in position contact the top surface 100 of the upper wing walls 76, 78. The flexible construction adhesive seeps into the holes 80 of the upper wing walls 76, 78 and provides a three dimensional bond firmly securing the filler panel to the upper wing walls.

When constructing a veneer panel wall, the installer must first construct a sufficiently rigid structure 36 that can withstand the load to be applied when the panels 12 are in position. The brackets 14 are secured to a wall stud 64 at preselected separation distances depending upon the dimensions of the panel 12. To secure a bracket 14 to a wall stud, typically a hexagonal headed cap screw 67 is inserted through the lug 66 of the center mount 62 and into the wall stud 64. When properly oriented, the channel 92 running between the upper and lower wing walls 72, 74, 76, 78 is horizontal in orientation. At least three, and preferably four, brackets 14 are typically be required to properly support a panel 12 in position on a structure.

Preferably, a panel 12 is supported at the four corners to minimize the prospect for shearing off a supporting screw because of excessive weight and to prevent rotation of the panel out of the brackets should an installer attempt to use only a single bracket at the lower edge and two brackets at the upper edge. A bracket in position at the lower edge of a wall requires only a wing wall on a single side of the bracket and a bracket positioned at the top of course of paneling likewise utilizes a bracket with only wing walls on a single side of the bracket.

Panels that are placed at the end of a wall are configured to accept an overhang portion 32 on the interior side of the panel but are not configured with a cutout portion near the edge of the wall as there is no adjacent panel installed that fills the void of the cutout 116 with an overhang 32. Consequently, some panel embodiments only include a single cutout portion 116 or a single overhang 32 depending upon where the panel 12 is to be installed in the wall.

Figure 7A:
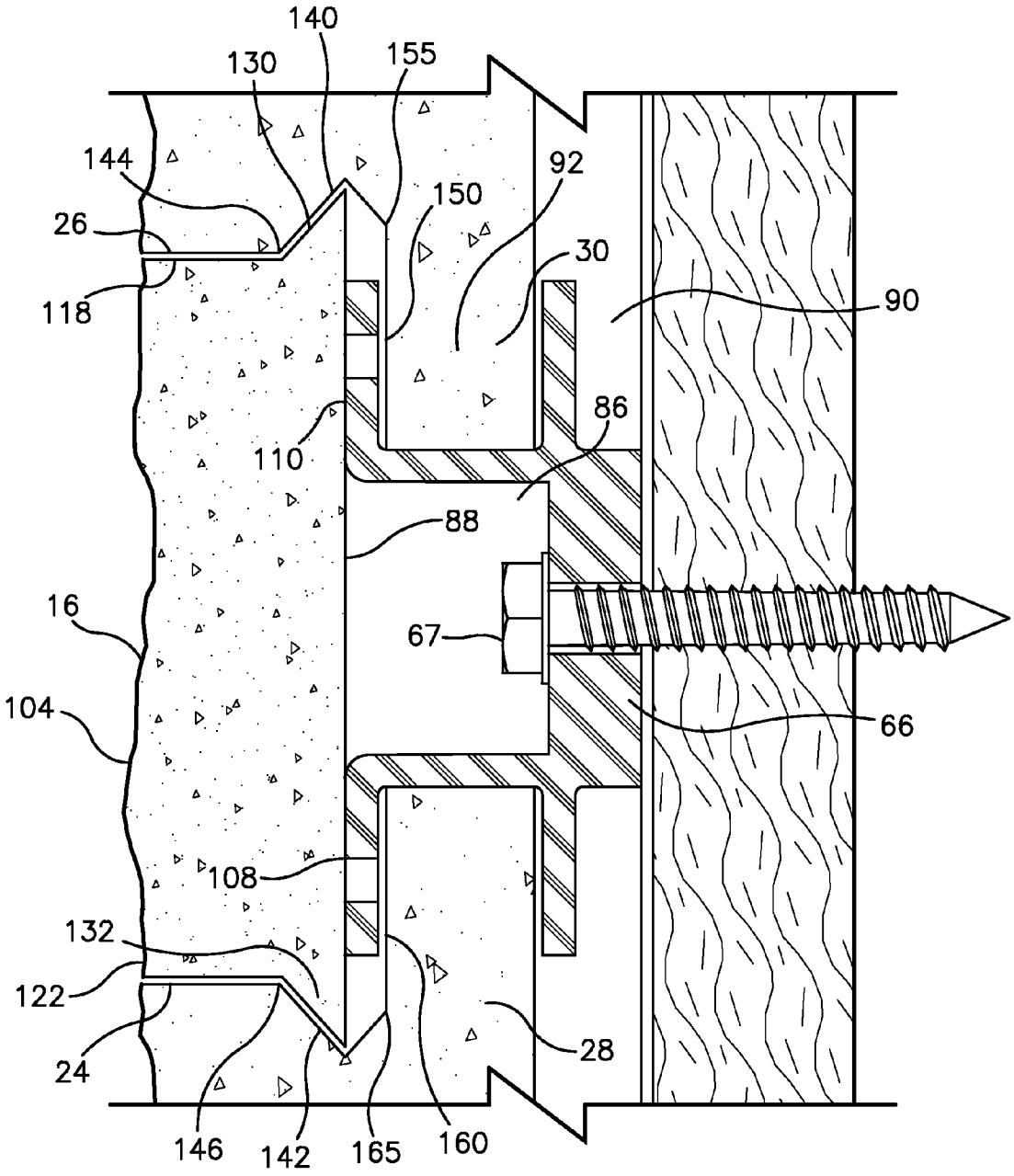
FIG. 7*a* is a sectional view of an embodiment of a bracket secured to the building structure with a screw and showing embodiments of two stone panels in position between the upper and lower wing walls and an embodiment of a filler panel disposed between the upper and lower stone panels.

In order to secure the filler panel 16 into the overall assembly and prevent the filler panel 16 from inadvertently falling out of the gap 102, slanted upper and lower back surfaces 130, 132, as best seen in FIG. 7*a*, are cast into the filler panel 16 during fabrication. Slanted surfaces 140, 142 are also cast into the panels 12, 12' at the rear area of the upper and lower surfaces 24, 26. Once the filler panel 16 is positioned into the area 102 above the first panel 12 and below the second panel 12', any attempt to extract the filler panel 16 by pulling it outwardly from the wall causes the slanted surfaces 130, 132 of the filler panel 16 to interfere with the slanted surfaces 140, 142 of the adjacent panels 12. In addition, as discussed above, an adhesive further secures the filler panel 16 in position between the upper and lower panels 12, 12'.

FIG. 7*a* also details the lower flange 30 extending downwardly into the channel 92 of the bracket 14. The panel 12' includes a vertical wall 150 that extends downwardly into the channel 92. The apex 155 of the slanted upper surface 140 is co-linear with the back face 88 of the filler panel 16 and the slanted surface 140 is angled downwardly to the lower ledge 26 to an intersection point 144. The slanted surface 140 is preferably canted from the lower ledge 26 at an angle in the range of from 20 to 50 degrees terminating at the apex 155.

FIG. 7*a* further details a comparable engagement structure on the lower side of the filler panel 16 with the upper flange 28 extending upwardly into the channel 92 of the bracket 14. The panel 12 includes a vertical wall 160 that extends upwardly into the channel 92. The lowermost point 165 of the slanted lower surface 142 is preferably co-linear with the back face 88 of the filler panel 16 and is angled upwardly to the panel upper surface 24 at intersection point 146. The slanted surface 142 is preferably canted from the panel upper ledge 24 at an angle in the range of from 20 to 50 degrees terminating at the apex 165.

Once the upper flange 28 of the first panel 12 is in position in the channel 92 the filler panel 16 can then be mounted. As best seen in FIG. 7*a*, once the first panel 12 is secured into position with brackets 14, the slanted surface 132 of the filler panel 16 is positioned atop, and behind, the slanted surface 142 of the lower course of stone paneling 12. In order to secure the filler panel 16 into position the next course of stone panel 12' is installed above the filler panel 16. During installation of the next course of stone panel 12', the installer positions the lower flange 30 of the stone panel 12' into the channel 92 between the wing walls 76, 78 of the bracket 14 and simultaneously with the insertion of the lower flange 30 into the channel 92, the installer places the slanted surface 130 of the filler panel 16 is positioned behind the slanted surface 140 of the upper course of the stone panel 12'. Once the upper course of the stone panel 12' is in position the filler panel 16 is effectively locked into position because of the overlap of the slanted surfaces 140, 142 of the upper and lower course 12, 12' with the slanted surfaces 130, 132 of the filler panel 16. Because the separation distance between the filler panel edges 118, 119 and the panel ledges 24, 26 is so small, the casual observer is unable to perceive any gap at all and considers the panel as a professionally installed, authentic stone wall.

To facilitate the installation of the first, and lowermost course of a stone veneer panel proximate a floor surface, the installation begins with the use of filler panels, and a starter bracket 150 as seen in FIG. 10. The starter bracket 150 includes two opposed brackets 152, 154 comparable in many respects to the brackets 14 referenced above that are used to secure the stone panels 12 into position on the structure. The first course starter bracket 150 also includes a spacer bar 156 that separates the two bracket elements 152, 154.

Figure 11:
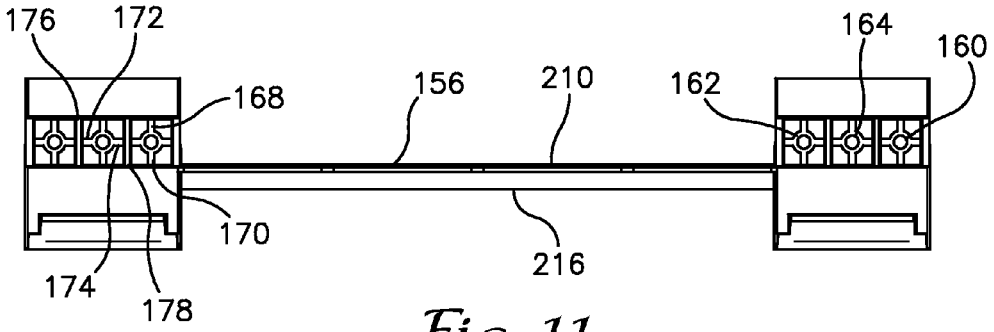
FIG. 11 is a front elevation view of an embodiment of a starter bracket for a first course of a stone veneer panel.
Figure 13:
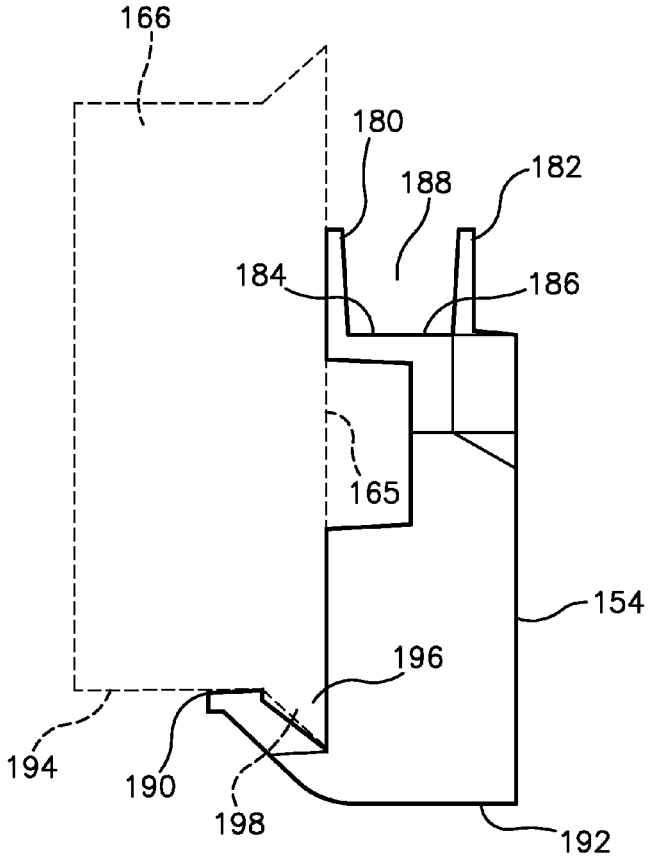
FIG. 13 is an end view of an embodiment of a starter bracket for a first course of a stone veneer panel.
Figure 14:
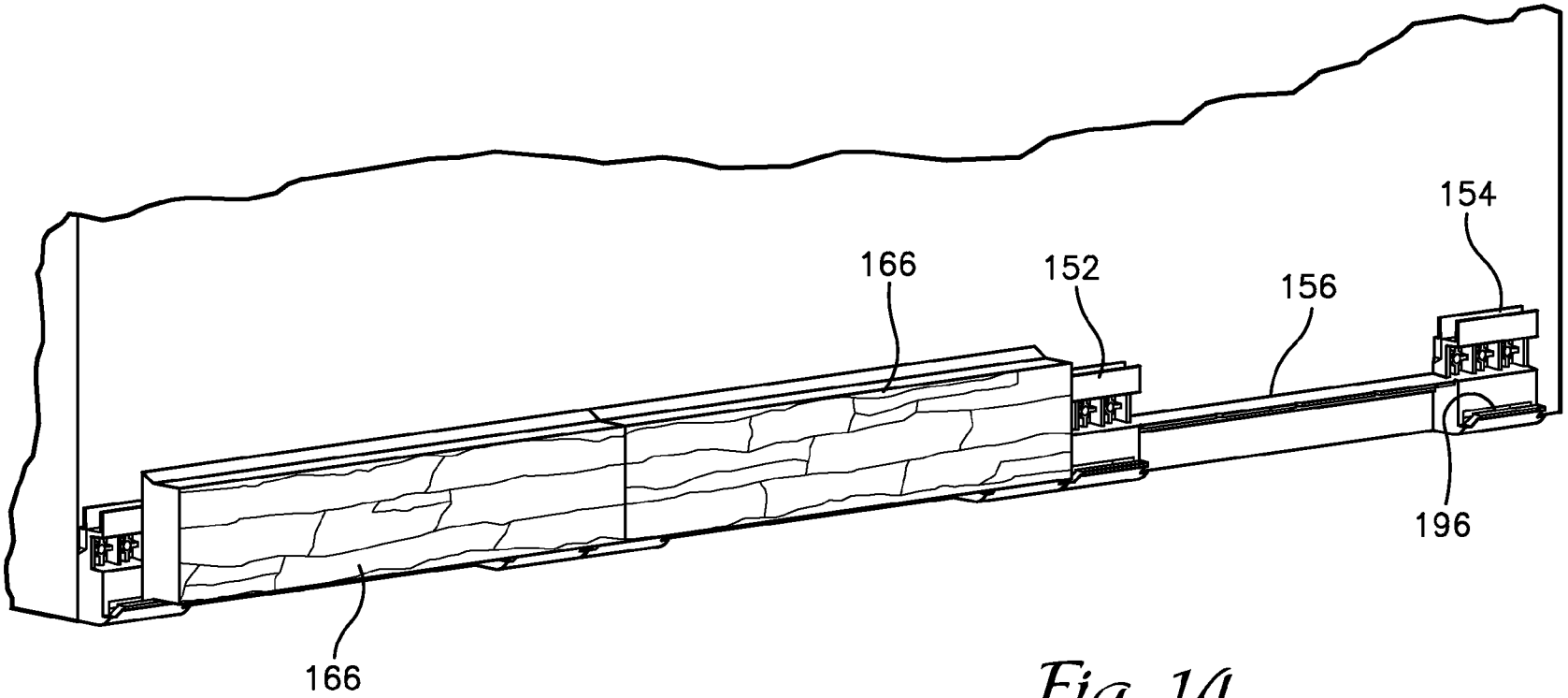
FIG. 14 is an isometric view of an embodiment of a starter bracket for a first course of a stone veneer panel.

As seen in FIG. 11, the brackets 152, 154 include a center mount 160 for securing the bracket to a structural feature such as a wall stud (not shown). The center mount 160 preferably comprises one or more adjacent circular lugs 162 through which an attachment means, preferably a threaded fastener (not shown), is passed to secure the bracket 152, 154 to a wall structural feature. The center mount 160 is also recessed into the brackets 152, 154 a sufficient distance to avoid interference between the head of the fastening device, passed through the center mount 160, and the rear surface 165, as seen in FIG. 13, of the installed filler panel 166. The circular lugs 162 are configured with openings 164 to accommodate, for example, a hexagonal headed cap screw, that is of sufficiently robust dimensions to support the weight of a filler panel 166, as seen in FIG. 14.

As seen in FIG. 11, the circular lug 162 is secured to two lateral webs 168, 170. The circular lug 162 is also secured to two longitudinal webs 172, 174. The longitudinal webs 172, 174 are themselves secured to two lateral walls 176, 178. The webs 168, 170, 172, 174 are sufficiently robust in their dimensions and in their connection strength to adjoining webs and walls to support the weight of the stone filler panels 166 and are preferably fabricated from an engineered plastic.

As seen in FIGS. 10 and 13, the brackets 152, 154 further employ upper wing walls 180, 182 that extend upwardly from the exterior surface 184 of a lateral wall 186 creating a gap 188 for receiving the lower flange 30 of the panel 12. As seen in FIG. 13, the brackets 152, 154 also utilize a step 190 that extends both upwardly and outwardly from the base 192 of the brackets 152, 154. The step 190 is configured to support the lower surface 194 of the filler panel 166 and also allows the canted back surface 196, as best seen in phantom in FIG. 13 that is cast into the filler panel 166 during fabrication, to nest into the canted region 198 of the bracket 152, 154 thereby securing the lower portion of the panel 166 into position on the bracket 152, 154.

Figure 12:
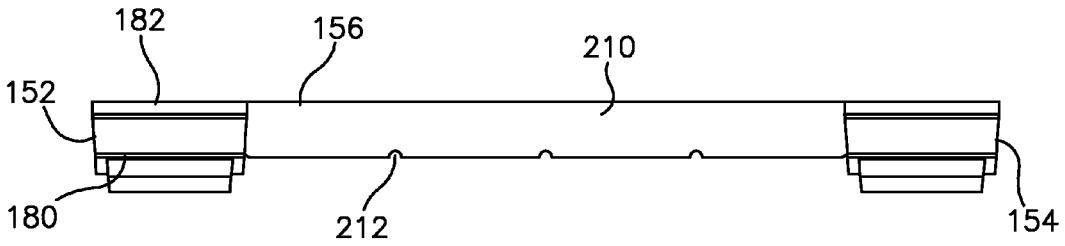
FIG. 12 is a plan view of an embodiment of a starter bracket for a first course of a stone veneer panel.

As noted above, and as seen in FIGS. 10-12, a spacer bar 156 separates brackets 152, 154. The spacer bar 156 preferably spans twelve inches, but longer, or shorter, lengths may also be utilized. A twelve inch separation between the brackets provides for a sixteen inch spacing at the mounting points on the brackets 152, 154. Since standard construction utilizes stud spacing of 16 inches-on-center, the bracket 152, 154 and twelve inch spacer bar 156 readily accommodate standard construction practices. The upper panel 210 of the spacer bar 156 also includes weep slots 212 that allow moisture to drain from upper areas of the installed stone veneer wall to lower areas and ultimately to ground level where the moisture can evaporate with reduced likelihood of mold formation on the back surfaces of the veneer panels 12 or more likely the building structural surfaces.

When in position, the weep slots 212 of the spacer bar 156, which preferably total three, but may be either greater or lesser in number, are positioned against the back surface of the filler panel 166. Fabricated into the upper panel 210 is a flange 216 that extends downwardly from the upper panel 201. Much like the rigidity of an I-beam used as a structural member of a building, the flange 216 and upper panel 210 combination inhibit flexing of the spacer bar 156 and maintains a rigid starter bracket 150.

Figure 15:
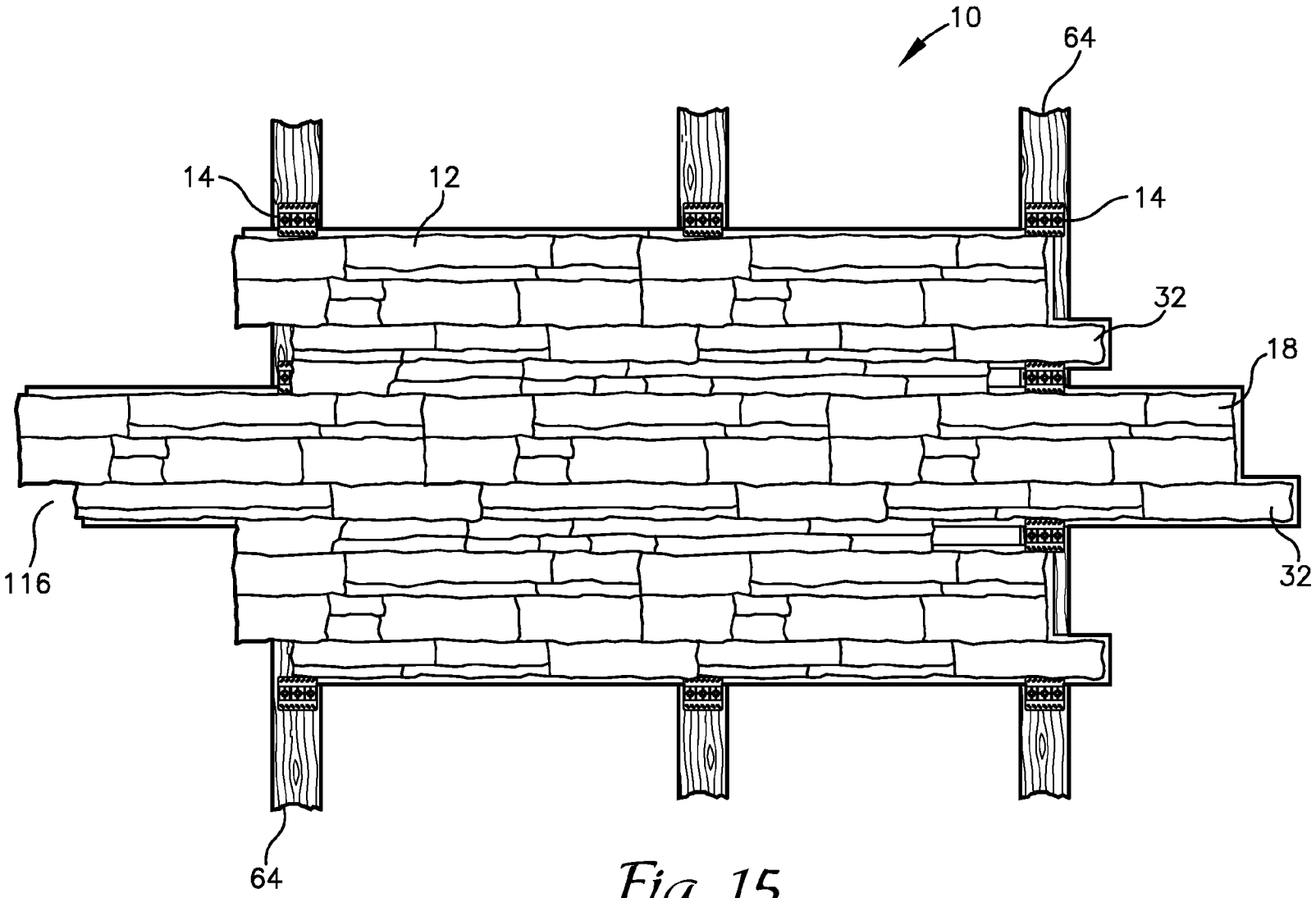
FIG. 15 is a perspective view of an embodiment of a stone veneer wall with the brackets, panels and filler panels in fully assembled position.

A fully assembled stone veneer panel wall with a mid-wall filler panel installed can be seen at FIG. 15. A stone veneer wall is preferably started at ground, or floor level, with the installation of a starter bracket 150 and a filler panel 166. The starter bracket 150 is secured to the building structure with fasteners through the circular lugs 162. Multiple adjacently horizontally disposed starter brackets 150, as best seen in FIG. 14, may be required to satisfactorily cover the span of the entire wall surface. The lower slanted back edge 196 of the filler panel 16 is inserted into the canted region 198 of the brackets 152, 154. The next installation step is to insert the lower flange 30 of the next higher course of paneling into the gap 188 between the wing walls 180, 182 of the brackets 152, 154. As this insertion of the flange 30 into the gap 188 between the wing walls is occurring the upwardly slanted back surface 130 of the filler panel is positioned behind the slanted surface 140 of the veneer panel 12. Once these slanted features are properly mated, the lower course filler panel 166 is effectively locked into position as the canted surfaces 130, 132 of the filler panel 16 prevent the filler panel 16 from moving outwardly from the wall surface. The course of veneer panel 12 that is immediately above the filler panel 16 has its lower edge locked into position by the wing walls 180, 182 of the starter bracket 150 and the upper edge of the veneer panel 12 is locked into position by the next level of brackets 14. The upper flange 28 of the veneer panel 12 is inserted between the wing walls 76, 78, 82, 84 of the next level of brackets 14 and the brackets are secured in position by passing a fastener through the circular lug 66 and into the building structure. This process is repeated as necessary along the same level horizontally until all panels 12 are secured into position and then vertically until the uppermost desired level is achieved.

Many different arrangements of the various components depicted, as well as components not shown, are possible without departing from the spirit and scope of the disclosed technology. Embodiments of the disclosed technology have been described with the intent to be illustrative rather than restrictive. Alternative embodiments will become apparent to those skilled in the art that do not depart from its scope. A skilled artisan may develop alternative means of implementing the aforementioned improvements without departing from the scope of the disclosed technology.

It will be understood that certain features and sub combinations are of utility and may be employed without reference to other features and sub combinations and are contemplated within the scope of the claims. Not all steps listed in the various figures need be carried out in the specific order described.

The invention claimed is:

1. A kit for securing stone veneer panels to a structure, the kit comprising:

at least one stone veneer panel, the panel including an upper surface and a lower surface, a front surface and a rear surface, a flange extending outwardly from a portion of the upper and lower surfaces of the panel and a first and second side surfaces for abutment with a horizontally adjacent panel;

a plurality of brackets for securing the at least one stone panel to the structure, the brackets secured to the structure through a bracket center mount, the brackets further comprising two lateral walls and two longitudinal walls, each wall having an interior and an exterior surfaces and an upper and lower edges, at least one upper wing wall extending outwardly from the upper edge of at least one of the lateral walls and at least one lower wing wall extending outwardly from the exterior surface of at least one lateral wall and disposed above the lower edge, the upper and lower wing walls forming a channel for receipt of the flange of the panel; and a filler panel to fill a gap between vertically adjacent panels, wherein the bracket is secured to the structure through the center mount and the filler panel is positioned between the vertically adjacent veneer panels.

2. The kit of claim 1, wherein the front face of the stone veneer panel provides an appearance of a realistic stone wall.

3. The kit of claim 1, wherein an adhesive is used to secure the filler panel to the bracket upper wing wall and to the flange of the stone panel.

4. The kit of claim 3, wherein the upper wing wall includes at least one through hole to facilitate the adhesion of the filler panel to the upper wing wall.

5. The kit of claim 1, wherein the bracket is secured to the structure with a retaining member passing through the center mount.

6. The kit of claim 5, wherein the retaining member is a hexagonal head cap screw.

7. The kit of claim 1, wherein the filler panel includes a front face and a rear face.

8. The kit of claim 1, wherein the filler panel front face comprises a natural stone appearance.

9. The kit of claim 1, wherein the center mount includes a circular lug through which a retaining member is secured to the structure.

10. The kit of claim 1, wherein when the bracket is secured to the structure a separation distance exists between the lower edge of the bracket which is in contact with the structure and the at least one lower wing wall, the separation distance facilitating the movement of air between the rear surface of the installed stone veneer panel and the structure thereby promoting removal of moisture from the structure.

11. The kit of claim 1, wherein the center mount is secured to at least one lateral reinforcing web and the lateral reinforcing web is secured to at least one longitudinal reinforcing web wherein the longitudinal reinforcing web is connected to the interior surface of at least one lateral wall.

12. The kit of claim 11, wherein the upper edge of the at least one longitudinal reinforcing web is recessed below the upper edge of the at least one lateral wall for receiving, without interference, the center rib of the filler panel.

13. The kit of claim 11, wherein the center mount is recessed below the upper edge of the at least one lateral wall to prevent interference with the center rib of the filler panel.

14. The kit of claim 1, wherein the bracket is comprised primarily of engineered plastic.

15. The kit of claim 1, wherein the filler panel further comprises oppositely disposed upper and lower surfaces extending rearwardly to the back face and substantially perpendicular to the front face.

16. The kit of claim 15, wherein the upper and lower surfaces further comprise a forward edge proximate the front face and a rear edge proximate the back face.

17. The kit of claim 16, wherein the upper surface of the filler panel further comprises an upwardly slanted surface on a portion of the upper surface proximate the rear edge.

18. The kit of claim 16, wherein the lower surface of the filler panel further comprises a downwardly slanted surface on a portion of the lower surface proximate the rear edge.

19. The kit of claim 1, wherein a portion of the upper surface of the at least one stone veneer panel is upwardly slanted at an angle in the range of from 20 to 50 degrees from the upper surface.

20. The kit of claim 1, wherein a portion of the lower surface of the at least one stone veneer panel is downwardly slanted at an angle in the range of from 20 to 50 degrees from the lower surface.

21. The kit of claim 20, wherein when installed onto the structure the upwardly slanted surface on the upper surface of the filler panel is disposed behind and engages with the upwardly slanted surface of an adjacently installed stone veneer panel preventing outward extraction of the filler panel from the adjacently secured veneer panels.

22. The kit of claim 21, wherein when installed onto the structure the downwardly slanted surface on the lower surface of the filler panel is disposed behind and engages with the downwardly slanted surface of the adjacently installed stone veneer panel preventing outward extraction of the filler panel from the adjacently secured veneer panels.

23. The kit of claim 1, wherein the plurality of brackets for securing the at least one stone panel to the structure includes a starter bracket for installing a lowermost course of paneling, the starter bracket further comprising oppositely disposed first and second mounting brackets separated by a spacer bar, the first and second mounting brackets further comprising upwardly extending wing walls forming a gap for receiving the lower flange of a stone veneer panel and a step extending upwardly and outwardly from a base of the bracket for supporting a lower surface of the filler panel and a sloped region adjacent the step for receiving a canted back surface of the filler panel.

* * * * *